US006252935B1

(12) United States Patent
Styrnol et al.

(10) Patent No.: US 6,252,935 B1
(45) Date of Patent: Jun. 26, 2001

(54) X-RAY RADIATOR WITH CONTROL OF THE POSITION OF THE ELECTRON BEAM FOCAL SPOT ON THE ANODE

(75) Inventors: Siegfried Styrnol, Nuremberg; Helmut Winkelmann, Eggolsheim, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/359,577

(22) Filed: Jul. 22, 1999

(30) Foreign Application Priority Data

Jul. 22, 1998 (DE) ..... 198 32 972

(51) Int. Cl.[7] ..... H01J 35/30
(52) U.S. Cl. ..... 378/137
(58) Field of Search ..... 378/137

(56) References Cited

U.S. PATENT DOCUMENTS

| | | | | |
|---|---|---|---|---|
| 4,637,040 | | 1/1987 | Sohval et al. | 378/9 |
| 4,748,650 | | 5/1988 | Ammann | 378/137 |
| 4,803,711 | | 2/1989 | Tsujii et al. | 378/4 |
| 4,819,260 | | 4/1989 | Haberrecker | 378/137 |
| 4,827,494 | | 5/1989 | Koenigsberg | 378/138 |
| 5,065,420 | | 11/1991 | Levene | 378/137 |
| 5,550,889 | * | 8/1996 | Gard et al. | 378/113 |
| 6,091,799 | * | 7/2000 | Schmidt | 378/137 |
| 6,111,934 | * | 8/2000 | Foerst et al. | 378/137 |
| 6,128,367 | * | 10/2000 | Foerst et al. | 378/137 |

FOREIGN PATENT DOCUMENTS 41 25 926 8/1992 (DE) .

* cited by examiner

*Primary Examiner*—David V. Bruce
*Assistant Examiner*—Allen C. Ho
(74) *Attorney, Agent, or Firm*—Schiff Hardin & Waite

(57) ABSTRACT

An x-ray radiator has an x-ray tube with a deflection arrangement that deflects the electron beam of the x-ray tube dependent on a control signal such that the position of the focal spot on the anode corresponds to a reference position changing as a function of time. A detector acquires the actual position of the focal spot and a control unit is supplied with the actual value signal and a reference signal and generates the control signal.

12 Claims, 3 Drawing Sheets

X-RAY RADIATOR WITH CONTROL OF THE POSITION OF THE ELECTRON BEAM FOCAL SPOT ON THE ANODE

BACKGROUND OF THE INVENTION

1. Field of the Invention

The present invention is directed to an x-ray radiator of the type having an x-ray tube containing a cathode and an anode in a vacuum housing, an electron beam emanating from the cathode during operation of the x-ray tube which strikes the anode in a focal spot from which x-rays emanate during operation of the x-ray tube, and having a deflection arrangement that deflects the electron beam such that the position of the focal spot on the anode changes as a function of the time.

2. Description of the Prior Art

Such an x-ray radiator of this type is disclosed in U.S. Pat. No. 4,637,040 as a component of a computed tomography (CT) apparatus. The deflection of the electron beam thereby ensues such that the focal spot assumes one of two discrete positions in alternation.

German OS 41 25 926 discloses a deflection means containing a deflection coil that generate a magnetic field for the deflection of the electron beam. The deflector coil is supplied with a current whose time curve corresponds to the desired deflection motion of the focal spot, or of the electron beam. In the case of this x-ray radiator, the speed with which the position of the focal spot can be changed is limited by the inductance of the deflection coil, which acts as a low-pass filter. The result is that the frequency with which the position of the focal spot can be changed is also limited.

U.S. Pat. Nos. 4,819,260 and 4,827,494, and 5,065,420 and 4,803,711 disclose keeping the position of the focal spot of an x-ray tube constant with suitable drive of a deflection means, also with the possibility of adjusting the focal spot to a limited extent. Details as to how the displacement of the focal spot can ensue at high speed, however, cannot be derived from these publications.

SUMMARY OF THE INVENTION

An object of the present invention is to provide an x-ray radiator of the type initially described wherein the change in position of the focal spot can ensue at high speed, and thus at high frequency.

This object is inventively achieved in accordance with the invention in an x-ray radiator having an x-ray tube containing a cathode and an anode in a vacuum housing, an electron beam emanating from the cathode during operation of the x-ray tube which strikes the anode in a focal spot from which x-rays emanate during operation of the x-ray tube, a deflection arrangement that deflects the electron beam dependent on a control signal such that the position of the focal spot on the anode corresponds to a reference position changing as function of the time, a detector that acquires the actual position of the focal spot and supplies actual value signal corresponding to the actual position of the focal spot, a reference signal generator which generates a reference signal corresponding to the reference position of the focal spot, and a control unit to which the actual value signal and the reference signal are supplied and that generates the control signal.

In the inventive x-ray radiator, thus, a control unit is provided that generates a control signal on the basis of an actual value signal, acquired with the detector, and a reference signal, this control signal assuring that the position of the focal spot can change at high speed, and thus with high frequency. Differing from the prior art, the deflection arrangement is not driven with a control signal that corresponds to the time curve of the position of the focal spot, but instead is driven with a signal whose time curve can substantially deviate from the desired time curve of the position of the focal spot but ultimately assures that the focal spot assumes a reference position at every point in time that is prescribed by the reference signal.

In a preferred embodiment, the deflection arrangement includes a deflection coil supplied with a deflection signal that generates a magnetic field for the deflection of the electron beam. Such a deflection coil can be advantageously located outside the vacuum housing of the x-ray tube, which is constructed of non-magnetic material, in the area of the deflection coil, so that degradation of the vacuum of the x-ray tube is avoided and easy replacement is assured as needed, these features being problematical, for example, given deflection electrodes arranged inside the x-ray tube.

When the deflection arrangement includes a deflection coil, in one version of the invention that the deflection arrangement, dependent on the control signal, supplies energy to the deflection coil in a first operating condition and withdraws energy therefrom in a second operating condition. Due to the presence of the control unit, thus, it is not necessary to supply the deflection coil with a signal whose time curve ultimately corresponds to the desired time curve of the position of the focal spot; it is sufficient to supply energy to or withdraw energy from the deflection coil, and therefore the deflection arrangement need not contain a costly amplifier but merely switching units.

Since the deflection of the electron beam that can be achieved with a specific voltage is dependent on the energy of the electrons, and thus on the tube voltage, in a preferred embodiment of the invention the deflection arrangement sets the voltage of the deflection signal dependent on the tube voltage of the x-ray tube. This ensures that the dissipated power arising in the deflection arrangement is no higher than required for the deflection of the electron beam given the momentarily existing tube voltage.

The voltage of the deflection signal preferably lies below 100 V, so that the deflection arrangement can be constructed of economical components.

The deflection arrangement thus modifies the amplitude of the current flux through the deflection coil by pulse-width modulation, and one embodiment of the invention, the deflection arrangement, modifies the frequency of the current flowing through the deflection coil dependent on the running difference determined by comparison of the actual value signal to the reference signal.

The detector preferably acquires the position of the focal spot electro-optically. In this context, the detector preferably has a diaphragm through which a spatially limited x-ray beam emanating from the focal spot passes so as to be incident on a radiation detector that supplies an output signal corresponding to the position of the striking, location of the x-ray beam on the radiation detector. Suitable radiation detectors are commercially obtainable.

The reference signal is preferably a periodical signal. This signal can contain a temporarily constant signal component that allows the neutral position of the focal spot to be set, i.e. that position that the focal spot assumes given the absence of the periodic signal component.

DESCRIPTION OF THE PREFERRED EMBODIMENTS

Figure 1:
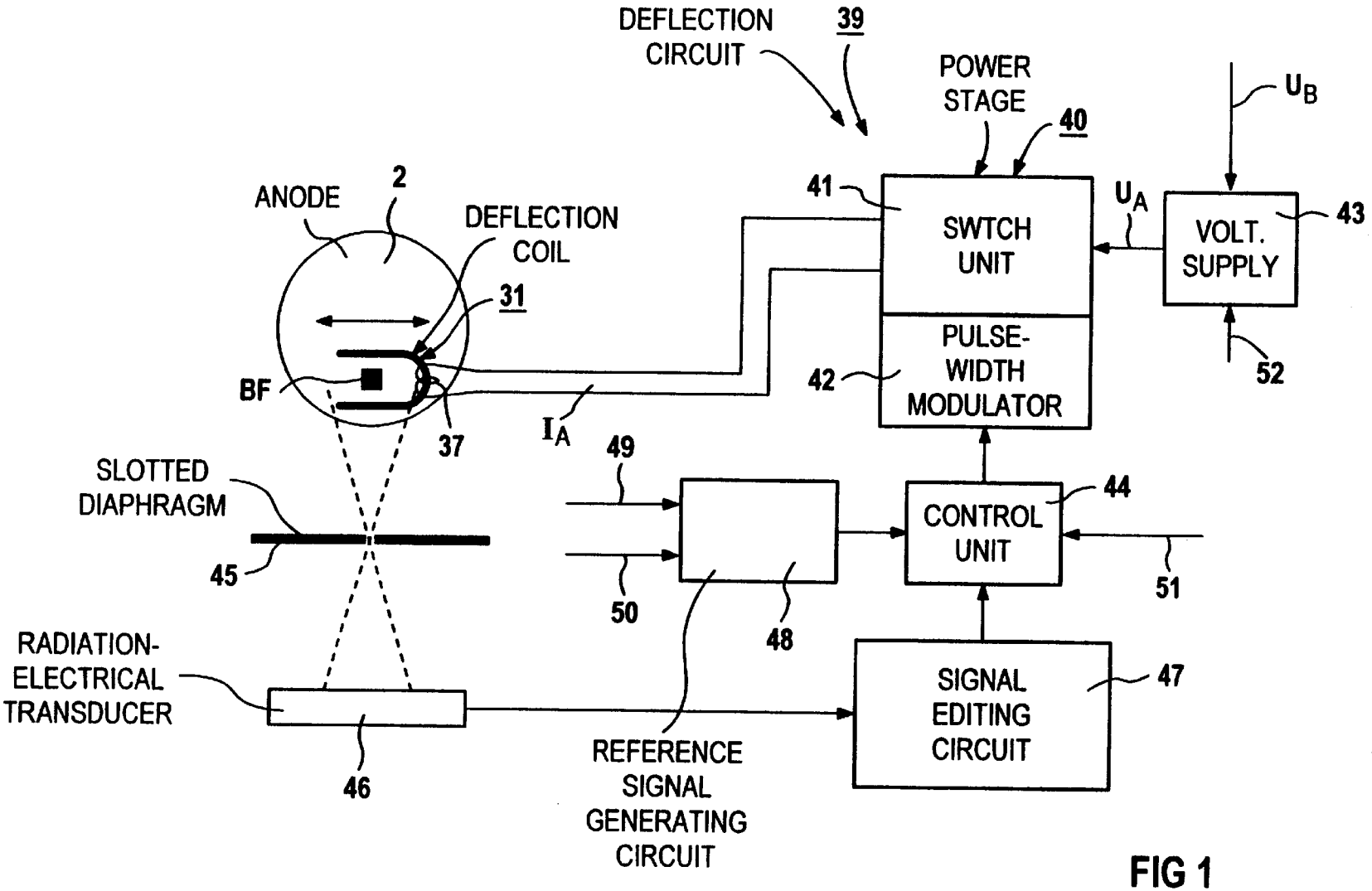
FIG. 1 is a block circuit diagram of an inventive x-ray radiator.

As shown in FIG. 1, the inventive x-ray radiator, which is suitable for utilization in a CT apparatus has an x-ray tube, of which only the anode dish of the rotating anode 2 with the focal spot BF and a deflection coil 31 are shown in FIG. 1.

Figure 2:
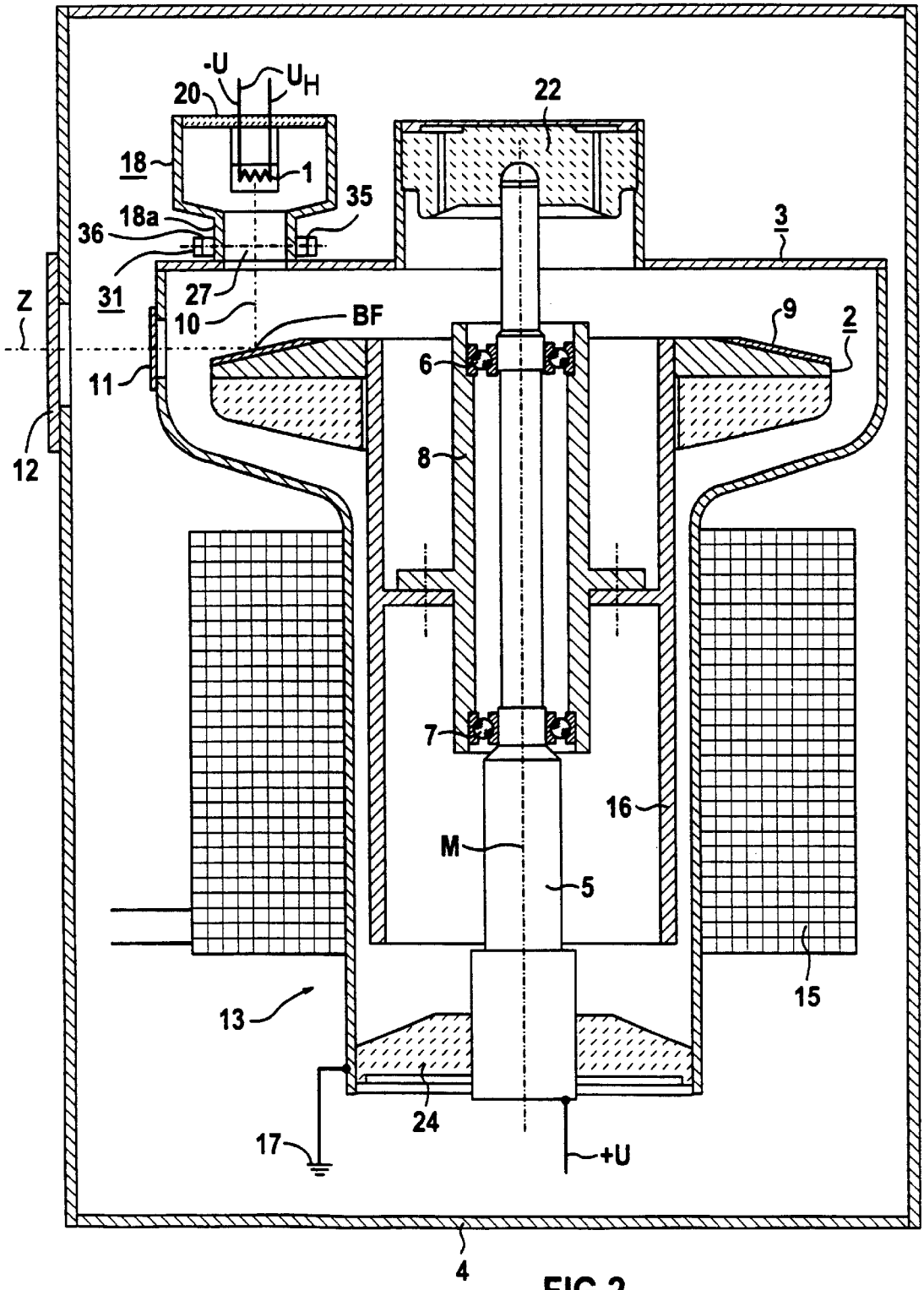
FIG. 2 shows the x-ray tube of the x-ray radiator according to FIG. 1 in longitudinal section.
Figure 3:
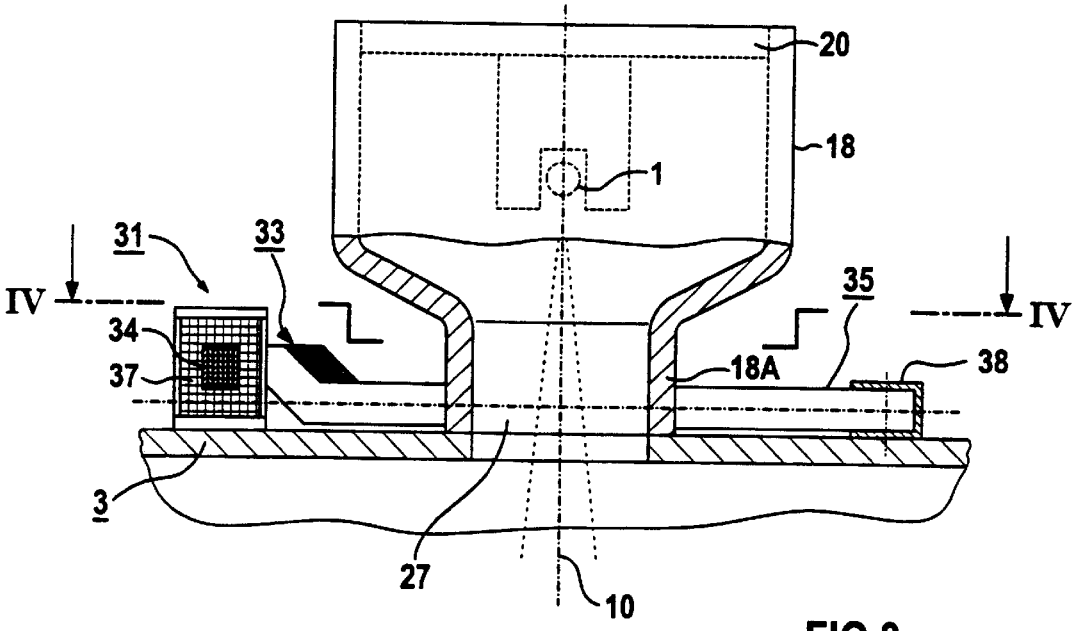
FIG. 3 is an enlarged illustration of a portion of the x-ray tube of FIG. 2, shown in section along the line III—III in FIG. 4.
Figure 4:
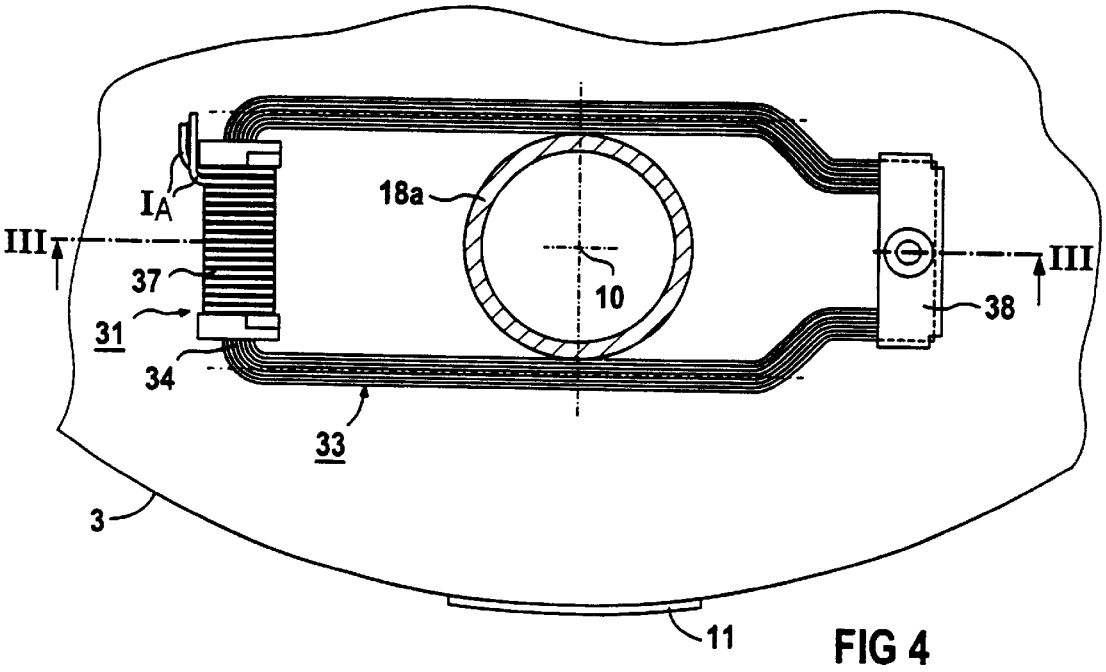
FIG. 4 is an enlarged illustration of a portion of the x-ray tube of FIG. 2, shown in section along the line IV—IV in FIG. 3.

As shown in FIGS. 2 through 4, the x-ray tube of the x-ray radiator has a stationary cathode 1 and the rotating anode 2, arranged in a vacuum-tight, evacuated vacuum housing 3 which is at ground potential. The vacuum housing 3 is contained in a protective housing 4 filled with an electrically insulating, liquid coolant, for example insulating oil. The rotating anode 2 is rotatably seated in the vacuum housing 3 with two roller bearings 6, 7 and a bearing sleeve 8 on a stationary shaft 5.

The rotating anode 2 fashioned rotational-symmetrically relative to the center axis M of the shaft 5 and has an annular incident surface 9 provided, for example, with a layer of a tungsten-rhenium alloy, on which the electron beam 10 emanating from the cathode 1 strikes for generating x-rays. In FIGS. 2 through 4, only the center axis of the electron beam 10 is shown with broken lines. The corresponding useful x-ray beam, of which only the central ray Z is shown in FIG. 2, emerges through beam exit windows 11 and 12 that are provided in the vacuum housing 3 and in the protective housing 4 and which are arranged aligned with one another.

An electric motor 13, such as squirrel cage induction motor, is provided for driving the rotating anode 2, this motor 13 having a stator 15 placed on the exterior of vacuum housing 3 and a rotor 16 located inside the vacuum housing 3 and torsionally connected to the rotating anode 2.

A funnel-shaped housing section 18 is connected via a hollow housing part 18*a* to the rest of the vacuum housing 3. The housing 3 at ground potential is formed of metallic material except for an insulator 20 carrying the cathode 1 and two insulators 22 and 24 accepting the shaft 5.

The cathode 1 is attached to the funnel-shaped housing section 18 with the insulator 20. The cathode 1 is thus located, so to speak, in a separate chamber of the vacuum housing 3 that is connected thereto via the hollow housing part 18*a*.

The shaft 5 is at the positive high-voltage +U for the rotating anode 2 and is accepted vacuum-tight in the insulator 22. The tube current thus flows via the roller bearings 6 and 7.

As can be seen from the schematic illustration of FIG. 2, one terminal of the cathode 1 is at the negative high-voltage −U. The filament voltage $U_H$ lies between the two terminals of the cathode 1. The lines leading to the cathode 1, the shaft 5, the vacuum housing 3 and the stator 15 are in communication in a known way with a voltage supply (not shown) located outside the protective housing 4 that supplies the voltages required for the operation of the x-ray tube. As is clear from the above, the x-ray tube according to FIG. 2 is of a type known as a two-pole tube. It can be seen from FIG. 2 that the electron beam emanating from the cathode 1 proceeds through the hollow housing part 18 on its way to the rotating anode 2. The hollow housing part 18*a* thus limits a diaphragm aperture 27. The dimensions thereof are selected such that they do not significantly exceed the dimensions required for an unimpeded passage of the electron beam 10.

The funnel-shaped housing part 18 and the upper wall of the vacuum housing 2 in FIG. 2 (at least these parts but preferably all metallic parts of the vacuum housing 3) are formed of non-magnetic materials, for example stainless steel, and thus limit a radially outwardly open annular space located outside the vacuum housing 3 in which the deflection coil 31, schematically indicated in FIG. 1, is arranged. The deflector coil 31 generates a magnetic deflection field for the electron beam 10 that deflects this in a plane proceeding perpendicularly to the plane of the drawing of FIG. 2, as can be seen from FIG. 3.

The deflection coil 31 has a U-shaped yoke 33 with two legs 35, 36 connected by a base section 34 and a winding 37 that surrounds the base section 34. The deflection coil 31 is arranged such that the hollow housing part 18*a* is located between the two legs 35, 36 of the yoke 33.

The winding 37 of the deflection coil 31 has its terminals in communication with the circuit schematic in FIG. 1, allowing a current $I_A$ to flow through the winding 37 as a deflection signal during operation of the x-ray tube.

When the deflection signal through the winding 37 is a direct current, the electron beam 10 is statically deflected, so that the static position of the focal spot BF can be adjusted on the rotating anode 1 dependent on the intensity of the current of the deflection signal. In this way, it is possible, given employment of the x-ray radiator in a CT apparatus, to adjust the position of the focal spot BF relative to the rotational center of the gantry of the CT apparatus and relative to a radiation detector (for conducting an examination of a subject) attached to the gantry lying opposite the x-ray radiator.

In order to achieve a positioning of the focal spot in a manner changing as function of time, the winding 37 is supplied with a deflection signal which is an alternating current that is superimposed on the direct current serving for the static displacement of the focal spot.

The yoke 33 is constructed of thin sheet metal lamellae in a known way and is fixed to the vacuum housing 3 with a clamp 38 screwed to the vacuum housing 3.

As can be seen from FIG. 3, the winding 37 of the deflection coil 31 is connected to a power stage 40 of a deflection circuit 39. The deflection circuit 39 also contains a switch unit 41 and a pulse-width modulator 42.

With the switch unit 42, the winding 37 can be optionally connected to a supply voltage 43 or to ground, so that either an energy introduction into the winding 37 ensues or an energy flow out of the winding 37 ensues. The pulse-width modulator 42 determines the duration for which a respective energy introduction or energy withdrawal respectively ensue.

The pulse-to-pause ratio (duty cycle) of the pulse-width modulator 42, and thus the current $I_A$ flowing through the winding 37 of the deflection coil 31, is determined by a control signal that is supplied to the pulse-width modulator 42 from a control unit 44.

The control unit 44 is supplied with a reference signal for the focal spot position and with an actual value signal identifying the actual position of the focal spot BF.

The actual value signal is acquired by gating a small portion (pencil beam) from the useful x-ray beam with a slotted diaphragm 45 in the way illustrated in FIG. 1 and this small beam is conducted onto a radiation-electrical transducer 46 that emits an electrical signal corresponding to the point of incidence of the small x-ray beam on its measuring surface, which thus corresponds to the position of the focal spot BF on the rotating anode 2. Suitable radiation-electrical transducers are commercially obtainable under the name PSD (Position-Sensitive Device).

The output signal of the radiation-electrical transducer 46 proceeds to a signal editing circuit 47 that edits this output signal so that it can be supplied to the control unit 44 as an actual value signal. The reference signal is supplied to the control unit 44 from a reference signal generating circuit 48. The reference signal generating circuit 48 has two inputs 49, 50, a signal corresponding to the amplitude of the displacement of the focal spot BF being supplied to the input 49 and a (preferably periodic) signal corresponding in terms of its signal shape to the time curve of the displacement of the focal spot BF being supplied to the input 50.

The control unit 44 has an input 51 to which an offset signal can be supplied that determines the static position of the focal spot BF on the rotating anode 2.

The inventive x-ray radiator has a control system that ensures that the position of the focal spot BF on the rotating anode 2 is brought into agreement with the respective rated position of the focal spot BF taking the respective actual position of the focal spot BF into consideration.

This makes it possible to realize deflection movements of the focal spot BF that could not be realized when an attempt was made to supply the deflection coil 31 with a current $I_A$ whose time curve corresponds to the desired time curve of the displacement of the focal spot. Given the inventive x-radiator, for example, it is thus possible to realize a time curve of the displacement of the focal spot that corresponds to a periodic trapezoidal function with a rise and decay times of, 40 ms respectively.

The voltage supply 43 has an input 52 via which a signal is supplied corresponding to the tube voltage $U_R$=+U+−U that has been set is supplied. Dependent on this signal, the voltage supply 43, in turn supplied with an operating voltage $U_B$, modifies its output voltage $U_A$ supplied to the switch unit 41 of the power stage 40 in order to take into consideration the fact that the deflection of the electron beam 10 that can be achieved with a specific voltage at the winding 37 of the deflection coil 31 is dependent on the energy of the electrons, and thus on the tube voltage $U_R$.

The voltage of the deflection signal supplied to the winding 37 of the deflection coil 31 lies below 100 V, preferably between 10 and 40 V. In this way, no high-voltage problems arise, differing, for example, from an electrostatic deflection of the electron beam.

The signals supplied to the inputs 49 and 50 of the reference signal generating circuit 48, to the input 51 of the control unit 44 and to the input 52 of the voltage supply 43 can be produced, for example, in the control unit of a CT apparatus wherein the inventive x-ray radiator is utilized.

In the described exemplary embodiment, a magnetic deflection of the electron beam is provided. Fundamentally, however, there is also the possibility of providing an electrostatic deflection instead of such electromagnetic deflection.

The tube of the above-described exemplary embodiment is a two-pole x-ray tube. Single-pole x-ray tubes, however, can also be utilized in an inventive x-ray radiator.

Instead of an x-ray tube provided with rotating anode given the described exemplary embodiment, an x-ray tube having stationary anode can be employed in an inventive x-ray radiator.

The above-described exemplary embodiment refers to the employment of an inventive x-ray radiator in a CT apparatus. Other medical and non-medical applications of the inventive x-ray radiator, however, are possible.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator, comprising:

an x-ray tube containing a cathode and an anode in a vacuum housing, said cathode emitting an electron beam which strikes the anode in a focal spot from which x-rays emanate;

a deflection arrangement that deflects the electron beam dependent on a control signal such that a position of the focal spot on the anode corresponds to a reference position which changes as a function of time;

a detector that acquires an actual position of the focal spot and emits an actual value signal corresponding to said actual position of the focal spot;

means for generating a reference signal corresponding to the reference position of the focal spot; and a control unit to which the actual value signal and the reference signal are supplied and that generates the control signal.

2. An x-ray radiator according to claim 1, wherein the deflection arrangement comprises a deflection coil supplied with a deflection signal that generates a magnetic field for the deflection of the electron beam.

3. An x-ray radiator according to claim 1, wherein the deflection arrangement supplies energy to the deflection coil in a first operating condition and withdraws energy from the deflection coil in a second operating condition.

4. An x-ray radiator according to claim 2, wherein the deflection arrangement sets a voltage of the deflection signal dependent on a tube voltage between said anode and said cathode.

5. An x-ray radiator according to claim 4, wherein the voltage of the deflection signal is below 100 V.

6. An x-ray radiator according to claim 2, wherein the deflection arrangement comprises a pulse-width modulator for setting a current flow through the deflection coil.

7. An x-ray radiator according to claim 6, wherein the deflection arrangement modifies a frequency of the current flowing through the deflection coil dependent on a running difference determined by comparison of the actual value signal to the reference signal.

8. An x-ray radiator according to claim 1 wherein said detector comprises a radiation-electrical transducer which acquires the position of the focal spot.

9. An x-ray radiator according to claim 8 wherein said detector comprises a diaphragm through which a spatially limited x-ray beam emanating from the focal spot is incident onto the radiation-electrical transducer, the radiation-electrical transducer emitting an output signal corresponding to a position of a point of incidence of the spatially limited x-ray beam on the radiation-electrical transducer.

10. An x-ray radiator according to claim 1, wherein said means for generating a reference signal generates a reference signal which is a periodic signal.

11. An x-ray radiator according to claim 10, wherein said means for generating a reference signal generates a reference signal containing a temporarily constant signal component.

12. An x-ray radiator according to claim 1, wherein said control unit generates said control signal as a periodic trapezoidal function having rise and decay times of 40 ms, respectively.

* * * * *